US012140010B2

(12) United States Patent
Wang et al.

(10) Patent No.: US 12,140,010 B2
(45) Date of Patent: *Nov. 12, 2024

(54) FRACTURING CONTROL APPARATUS AND CONTROL METHOD THEREFOR

(71) Applicant: YANTAI JEREH PETROLEUM EQUIPMENT & TECHNOLOGIES CO., LTD., Yantai (CN)

(72) Inventors: Kai Wang, Yantai (CN); Weiwei Liu, Yantai (CN); Peng Wang, Yantai (CN); Song Zhang, Yantai (CN); Pengyuan Zhang, Yantai (CN); Zhen Huang, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/080,487

(22) Filed: Dec. 13, 2022

(65) Prior Publication Data

US 2023/0119725 A1 Apr. 20, 2023

Related U.S. Application Data

(63) Continuation of application No. 17/742,627, filed on May 12, 2022, now Pat. No. 11,549,349.

(30) Foreign Application Priority Data

May 12, 2021 (CN) ..... 202110515828.0

(51) Int. Cl.
*E21B 43/26* (2006.01)
*E21B 43/27* (2006.01)

(52) U.S. Cl.
CPC ..... *E21B 43/2607* (2020.05); *E21B 43/26* (2013.01); *E21B 43/27* (2020.05)

(58) Field of Classification Search
CPC ..... E21B 43/2607; E21B 43/26; E21B 43/27; F04B 49/06; F04B 49/10
See application file for complete search history.

(56) References Cited

U.S. PATENT DOCUMENTS 11,549,349 B2 * 1/2023 Wang ..... E21B 43/2607
2010/0224365 A1 * 9/2010 Abad ..... E21B 43/26 166/275

(Continued)

FOREIGN PATENT DOCUMENTS

CN 103726821 A 4/2014
CN 105126669 A 12/2015

(Continued)

OTHER PUBLICATIONS

Written Opinion and International Search report for PCT Application No. PCT/CN2022/083087 mailed on Jun. 27, 2022.

*Primary Examiner* — Brad Harcourt
(74) *Attorney, Agent, or Firm* — Sheppard Mullin Richter & Hampton LLP

(57) ABSTRACT

In a fracturing control apparatus, a first chemical agent storage tank is connected with a first delivery pump, and a material outlet of the first delivery pump communicates with a first position of a first fracturing fluid conveying pipeline. An outlet of the first fracturing fluid conveying pipeline communicates with an inlet of a fracturing pump, an outlet of the fracturing pump communicates with an inlet of a second fracturing fluid conveying pipeline, and a first flow detector is arranged at a second position of the second fracturing fluid conveying pipeline. The first delivery pump is connected with a first output interface of a controller, and the first flow detector is connected with a first input interface of the controller. The fracturing control apparatus and the (Continued)

control method of the fracturing control apparatus are used for adding chemical agents into fracturing fluids.

19 Claims, 12 Drawing Sheets

(56) References Cited

U.S. PATENT DOCUMENTS

| | | | |
|---|---|---|---|
| 2014/0352962 | A1 | 12/2014 | Chung et al. |
| 2015/0252661 | A1 | 9/2015 | Glass |
| 2016/0032703 | A1 | 2/2016 | Broussard et al. |
| 2016/0258267 | A1 | 9/2016 | Payne et al. |
| 2016/0305223 | A1 | 10/2016 | Phillippi et al. |
| 2017/0226842 | A1 | 8/2017 | Omont et al. |
| 2019/0112910 | A1 | 4/2019 | Oehring et al. |

FOREIGN PATENT DOCUMENTS

| | | | |
|---|---|---|---|
| CN | 204973697 | U | 1/2016 |
| CN | 205773458 | U | 12/2016 |
| CN | 107694458 | A | 2/2018 |
| CN | 109209323 | A | 1/2019 |
| CN | 113236216 | A | 8/2021 |
| CN | 215057303 | U | 12/2021 |

* cited by examiner

FRACTURING CONTROL APPARATUS AND CONTROL METHOD THEREFOR

CROSS-REFERENCE TO RELATED APPLICATIONS

This application is a continuation of U.S. patent application Ser. No. 17/742,627 filed on May 12, 2022, entitled "FRACTURING CONTROL APPARATUS AND CONTROL METHOD THEREFOR," which claims priority to Chinese Patent Application No. 202110515828.0 filed on May 12, 2021. The entire contents of all of the above-identified applications are incorporated herein by reference in their entirety.

TECHNICAL FIELD

The application relates to the technical field of oil and gas exploitation, and in particular, to a fracturing control apparatus and a control method therefor.

BACKGROUND

In a fracturing process, in order to meet technological requirements and improve a fracturing effect, it is generally necessary to add chemical agents to fracturing fluids.

However, in the related art, the addition of the chemical agents is manually controlled at an operation site, and this control manner inevitably leads to a problem of untimely control.

SUMMARY

The application provides a fracturing control apparatus and a control method therefor, which addresses the technical problem of untimely control of the addition of chemical agents during a manual operation at an operation site.

In a first aspect, according to some embodiments of the present application, a fracturing control apparatus is provided. The fracturing control apparatus includes a first chemical agent storage tank, a first delivery pump, a fracturing pump, a first flow detector, a first fracturing fluid conveying pipeline, a second fracturing fluid conveying pipeline, and a controller. The first chemical agent storage tank is connected with the first delivery pump, and a material outlet of the first delivery pump communicates with a first position of the first fracturing fluid conveying pipeline. An outlet of the first fracturing fluid conveying pipeline communicates with an inlet of the fracturing pump, an outlet of the fracturing pump communicates with an inlet of the second fracturing fluid conveying pipeline, and the first flow detector is arranged at a second position of the second fracturing fluid conveying pipeline. The first delivery pump is connected with a first output interface of the controller, and the first flow detector is connected with a first input interface of the controller.

Optionally, in one embodiment, the fracturing control apparatus further comprises a display device with an input end and a control mode information collection device. The display device is connected with a second input interface of the controller, and the display device is connected with a second output interface of the controller. The control mode information collection device is connected with a third input interface of the controller.

Optionally, in one embodiment, the fracturing control apparatus further comprises a fault information acquisition device and an alarm. The fault information acquisition device is connected with a fourth input interface of the controller. The alarm is connected with a third output interface of the controller.

Optionally, in one embodiment, the fracturing control apparatus further comprises a second flow detector. The material outlet of the first delivery pump communicates with the first position of the first fracturing fluid conveying pipeline by the second flow detector, and the second flow detector is connected with a fifth input interface of the controller.

Optionally, in one embodiment, the fracturing control apparatus further comprises a first valve. The first chemical agent storage tank is connected with the first delivery pump via the first valve, and the first valve is connected with a fourth output interface of the controller.

Optionally, in one embodiment, the fracturing control apparatus further comprises a second chemical agent storage tank, a second delivery pump, a third flow detector, and a second valve. The second chemical agent storage tank is connected with the second delivery pump, and a material outlet of the second delivery pump is connected with a third position of the first fracturing fluid conveying pipeline. The second delivery pump is connected with a fifth output interface of the controller. The material outlet of the second delivery pump communicates with the third position of the first fracturing fluid conveying pipeline by the third flow detector, and the third flow detector is connected with a sixth input interface of the controller. The second chemical agent storage tank is connected with the second delivery pump via the second valve, and the second valve is connected with a sixth output interface of the controller.

Optionally, in one embodiment, the fracturing pump is connected with a seventh output interface of the controller.

In a second aspect, according to some embodiments of the present application, a control method is provided. The control method may be performed by the fracturing control apparatus. The control method includes acquiring a discharge amount value of the fracturing fluids pumped by the fracturing pump; and adjusting a flow of the chemical agents delivered by the first delivery pump into the first fracturing fluid conveying pipeline according to the discharge amount value of the fracturing fluids.

Optionally, in one embodiment, before the adjusting the flow of the chemical agents delivered by the first delivery pump into the first fracturing fluid conveying pipeline according to the discharge amount value of the fracturing fluids, the method further includes acquiring a control mode. The control mode includes an automatic control mode. The adjusting the flow of the chemical agent delivered by the first delivery pump into the first fracturing fluid conveying pipeline according to the discharge amount value of the fracturing fluids may include: adjusting, according to the discharge amount value of the fracturing fluids and a pre-stored target flow of the chemical agents corresponding to the discharge amount value of the fracturing fluids, the flow of the chemical agents delivered by the first delivery pump into the first fracturing fluid conveying pipeline to the target flow of the chemical agent when the control mode is the automatic control mode.

Optionally, in one embodiment, before the adjusting the flow of the chemical agent delivered by the first delivery pump into the first fracturing fluid conveying pipeline according to the discharge amount value of the fracturing fluids, the method may include acquiring a control mode. The control mode includes a manual control mode. The adjusting the flow of the chemical agents delivered by the first delivery pump into the first fracturing fluid conveying pipeline according to the discharge amount value of the fracturing fluids may include: acquiring a setting flow of the chemical agents inputted by the user, and adjusting the flow of the chemical agents delivered by the first delivery pump into the first fracturing fluid conveying pipeline to the setting flow of the chemical agents when the control mode is the manual control mode.

The beneficial effects brought by the application include the follows.

In various embodiments of the present application, the fracturing control apparatus may include a first chemical agent storage tank, a first delivery pump, a fracturing pump, a first flow detector, a first fracturing fluid conveying pipeline, a second fracturing fluid conveying pipeline, and a controller; the first chemical agent storage tank is connected with the first delivery pump, and a material outlet of the first delivery pump communicates with a first position of the first fracturing fluid conveying pipeline; an outlet of the first fracturing fluid conveying pipeline communicates with an inlet of the fracturing pump, an outlet of the fracturing pump communicates with an inlet of the second fracturing fluid conveying pipeline, and the first flow detector is arranged at a second position of the second fracturing fluid conveying pipeline; the first delivery pump is connected with a first output interface of the controller, and the first flow detector is connected with a first input interface of the controller; such that the controller may collect the discharge amount value of the fracturing fluid detected by the first flow detector and pumped by the fracturing pump, and control the first delivery pump according to the discharge amount value of the fracturing fluid pumped by the fracturing pump, thereby adjusting the flow of the chemical agents delivered by the first delivery pump to realize the adjustment of the amount of the chemical agents added in the fracturing fluids, thereby obviating manual control performed by technicians at operation site, and realizing timely control of the amount of addition of the chemical agents.

BRIEF DESCRIPTION OF DRAWINGS

In order to illustrate the technical solutions of the embodiments of the present application more clearly, the accompanying drawings used in the description of the embodiments will be briefly introduced in the following. Obviously, the drawings in the following description are some embodiments of the present application. For those skilled in the art, other drawings can also be obtained based on these drawings without any creative effort. In the attached drawings:

FIG. 2 is a schematic structural diagram of another fracturing control apparatus according to some embodiments of the present application;

FIG. 6-1 and FIG. 6-2 are schematic structural diagrams of still another fracturing control apparatus according to some embodiments of the present application;

FIG. 7-1 and FIG. 7-2 are schematic structural diagrams of still another fracturing control apparatus according to some embodiments of the present application;

FIG. 8-1 and FIG. 8-2 are schematic structural diagrams of still another fracturing control apparatus according to some embodiments of the present application;

FIG. 10-1 and FIG. 10-2 are schematic structural diagrams of still another fracturing control apparatus according to some embodiments of the present application;

DRAWING REFERENCE

Figure 1:
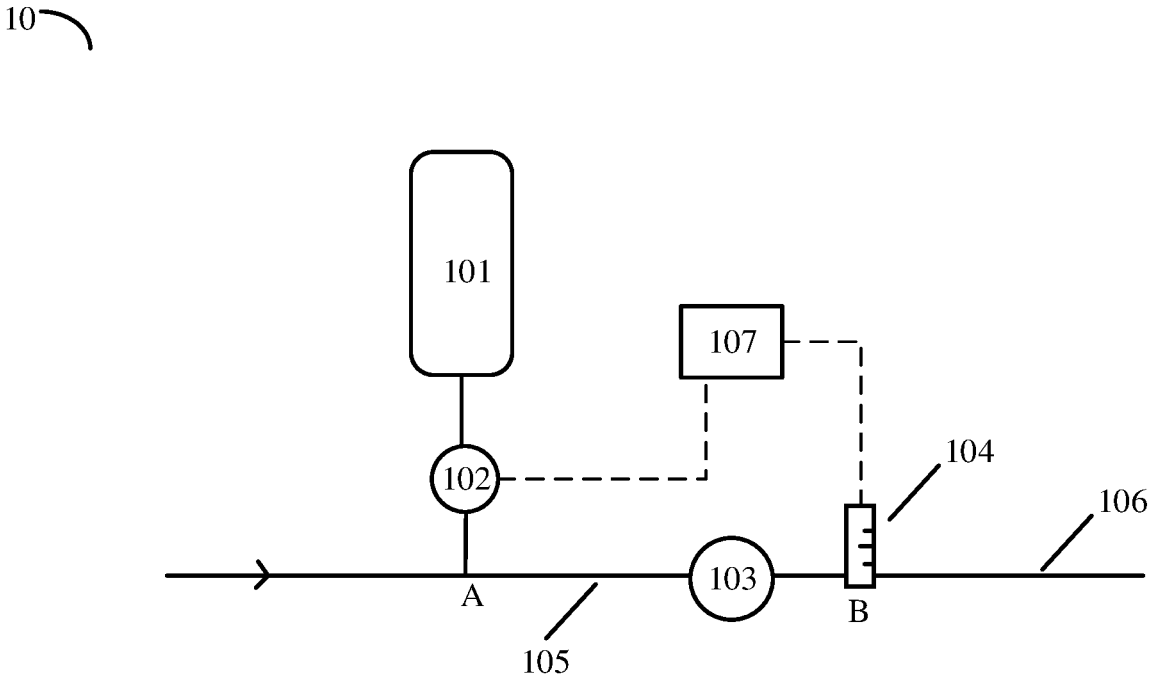
FIG. 1-1 and FIG. 1-2 are schematic structural diagrams of a fracturing control apparatus according to some embodiments of the present application.

10—fracturing control apparatus; 101—first chemical agent storage tank; 102—first delivery pump; 103—fracturing pump; 104—first flow detector; 105—first fracturing fluid conveying pipeline; 106—second fracturing fluid conveying pipeline; 107—controller; 108—display device; 109—control mode information collection device; 110—fault information acquisition device; 111—alarm; 112—second flow detector; 113—first valve; 114—second chemical agent storage tank; 115—second delivery pump; 116—third flow detector; 117—second valve; 118—liquid supply device.

DETAILED DESCRIPTION

In order to make the purpose, technical solutions, and advantages of this application clearer, the technical solutions of the present application will be clearly and completely described below with reference to the accompanying drawings and embodiments. The described embodiments are only a part of the embodiments of the present application, but not all of the embodiments. Based on the embodiments in this application, all other embodiments obtained by those skilled in the art without creative efforts shall fall within the protection scope of this application.

The features of the terms "first" and "second" in the description and claims of this application may expressly or implicitly comprise one or more of such features. In the description of this application, unless stated otherwise, "the plurality of" means two or more. In addition, "and/or" in the description and claims indicates at least one of the connected objects, and the character "I" generally indicates that the associated objects before and after are an "or" relationship.

In the description of this application, the orientation or positional relationship indicated by the terms "center", "longitudinal", "lateral", "length", "width", "thickness", "upper", "lower", "front", "back", "left", "right", "vertical", "horizontal", "top", "bottom", "inner", "outer", "clockwise", "counterclockwise", "axial", "radial", "circumferential" etc. are based on the orientation or positional relationship shown in the drawings, and are only for the convenience of describing the present application and simplifying the description, rather than indicating or implying that the referred device or element must have a particular orientation, be constructed and operate in a particular orientation, and therefore should not be construed as a limitation of the present application.

In the description of this application, unless otherwise expressly specified and limited, the terms "installed," "attached," and "connected" should be understood in a broad sense, for example, it may be a fixed connection or a detachable connection, or an integral connection; it may be mechanical connection or electrical connection; it may be directly connected, or indirectly connected through an intermediate medium, and it may be internal communication between two elements. For those skilled in the art, the specific meanings of the above terms in this application can be understood in specific situations.

As described in the background of the present application, the control of addition of the chemical agent in the related art is manually controlled at an operation site, and this control manner will inevitably lead to the problem of untimely control.

Figures 1, 2:
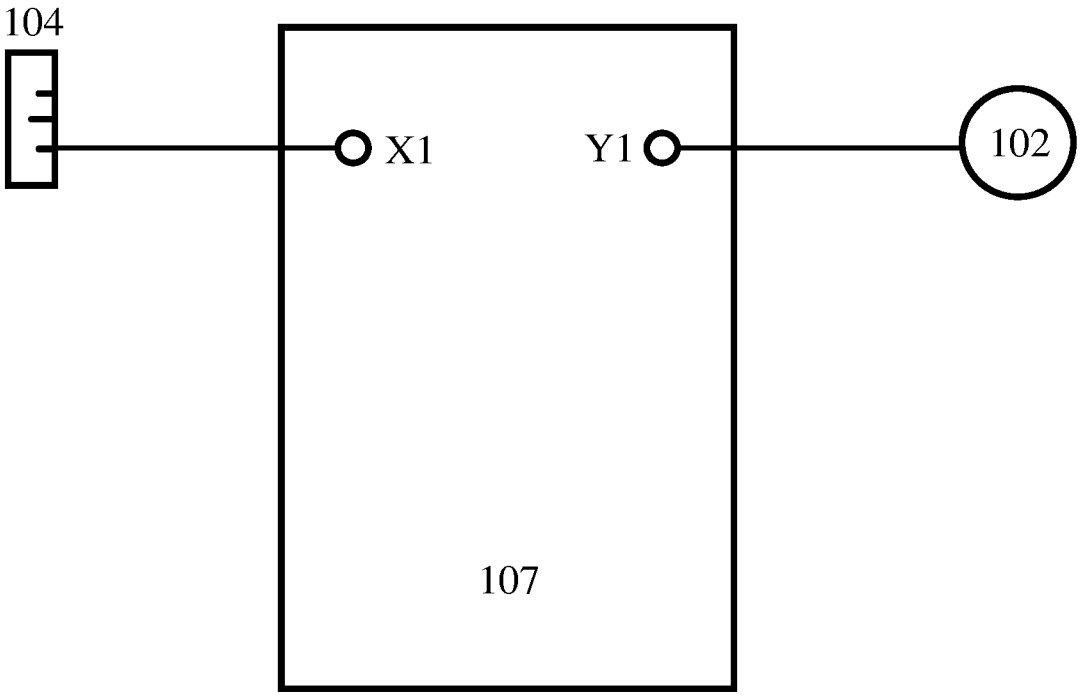
Figure 2:
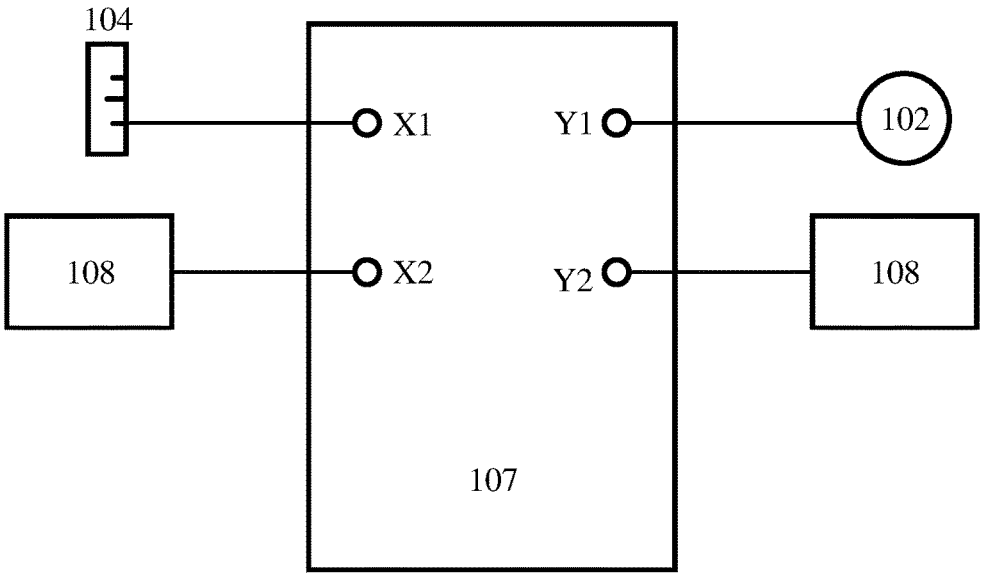

In view of this, an embodiment of the present application provides a fracturing control apparatus 10, as shown in FIG. 1-1 and FIG. 1-2, the fracturing control apparatus 10 includes a first chemical agent storage tank 101, a first delivery pump 102, a fracturing pump 103, a first flow detector 104 (also referred to as first flow detection element), a first fracturing fluid conveying pipeline 105, a second fracturing fluid conveying pipeline 106, and a controller 107. The first chemical agent storage tank 101 is connected with the first delivery pump 102, and a material outlet of the first delivery pump 102 communicates with a first position A of the first fracturing fluid conveying pipeline 105. An outlet of the first fracturing fluid conveying pipeline 105 communicates with an inlet of the fracturing pump 103, an outlet of the fracturing pump 103 communicates with an inlet of the second fracturing fluid conveying pipeline 106, and the first flow detector 104 is arranged at a second position B of the second fracturing fluid conveying pipeline 106; the first delivery pump 102 is connected with a first output interface Y1 of the controller 107, and the first flow detector 104 is connected with a first input interface X1 of the controller 107.

The chemical agent storage tank 101 may store chemical agents, and the chemical agents may be thickeners, cross-linking agents, filtrate reducers, pH adjusters, and the like. The first chemical agent storage tank 101 is connected with the first delivery pump 102, and may be used to provide chemical material for the first delivery pump 102.

The material outlet of the first delivery pump 102 is communicated with the first position A of the first fracturing fluid conveying pipeline 105, which may provide the power to transport the chemical agent in the first chemical agent storage tank 101 to the first fracturing fluid conveying pipeline 105, so that the chemical agent is mixed in the first fracturing fluid conveying pipeline 105 with the fracturing fluids delivered in the first fracturing fluid conveying pipeline 105. The first delivery pump 102 is connected with the first output interface Y1 of the controller 107. In one example, a power element of the first delivery pump 102 may be connected with the first output interface Y1 of the controller 107. The controller 107 may output an instruction to adjust an operating state of the power element, so as to control the first delivery pump 102, and then control the flow of the chemical agent pumped by the first delivery pump 102 (for example, when the first delivery pump 102 is a rotor pump, the flow of the pumped chemical agent may be controlled by controlling the rotational speed). In some embodiments, the first delivery pump 102 may be a plunger pump, a rotor pump, a centrifugal pump, etc., and the power element may be an engine, a motor, a hydraulic power take-off, and the like.

The inlet of the fracturing pump 103 is communicated with the outlet of the first fracturing fluid conveying pipeline 105, and the outlet of the fracturing pump 103 is communicated with the inlet of the second fracturing fluid conveying pipeline 106, which may provide the power to transport the fracturing fluid transported in the first fracturing fluid conveying pipeline 105 (including fracturing fluids without chemical agent or fracturing fluids with added chemical agent) to the second fracturing fluid conveying pipeline 106, and may further provide the power to pump the fracturing fluid in the second fracturing fluid conveying pipeline 106 into the wellbore to perform fracturing operations. In practical applications, the fracturing pump 103 may be a plunger pump, a rotor pump, a centrifugal pump, or the like.

The first flow detector 104 is arranged at the second position B of the second fracturing fluid conveying pipeline 106. The first flow detector 104 may be arranged at the outlet of the fracturing pump 103 and may detect the discharge amount value of the fracturing fluids pumped by the fracturing pump 103. The first flow detector 104 is connected with the first input interface X1 of the controller 107, and the controller 107 may acquire the discharge amount value of the fracturing fluids detected by the first flow detector 104 and pumped by the fracturing pump 103. In practical applications, the first flow detector 104 may be a flow meter.

In some embodiments, in the fracturing control apparatus 10 provided in the embodiment of the present application, the first delivery pump 102 is connected with the first output interface Y1 of the controller 107, and the first flow detector 104 is connected with the first input interface X1 of the controller 107, such that the controller 107 may acquire the discharge amount value of the fracturing fluid detected by the first flow detector 104 and pumped by the fracturing pump 103, and control the first delivery pump 102 according to the discharge amount value of the fracturing fluid pumped by the fracturing pump 103, thereby adjusting the flow of the chemical agents delivered by the first delivery pump 102 to realize the adjustment of the amount of the chemical agents added in the fracturing fluids, thereby obviating manual control performed by technicians at operation site, and realizing timely control of the amount of addition of the chemical agents.

Further, the controller 107 may include a memory, and the memory may store the proportional relationship between the flow of the chemical agent and the discharge amount value of the fracturing fluid preset by the technician, such as 20%, and the controller 107 may determine the target flow of the chemical agent corresponding to the current discharge amount value of the fracturing fluid according to the discharge amount value of the fracturing fluid detected in real time by the first flow detector 104 and the proportional relationship stored in the memory, and thereby adjusting the flow of the chemical agents pumped by the first delivery pump 102 in real time according to the target flow of the chemical agents.

In some embodiments, the controller 107 may be arranged at a position far from the operation site, so as to facilitate remote control of the addition of chemical agents, and may also avoid the threat to the operator's personal safety caused by manual control on the operation site. The connection between the controller 107 and other devices may be a wired connection or a wireless connection.

In order to flexibly control the first delivery pump 102, in one embodiment, the fracturing control apparatus 10 provided by the embodiment of the present application further includes a display device 108 with an input end. As shown in FIG. 2, in some embodiments, the display device 108 is connected with a second input interface X2 of the controller 107, and the display device 108 is connected with a second output interface Y2 of the controller 107.

The display device 108 has an input end, and the input end may be a keyboard, a mouse, or a touch display screen of the display device 108. The display device 108 is connected with the second input interface X2 of the controller 107, and the display device 108 is connected with the second output interface Y2 of the controller 107. The controller 107 may display the collected data on the display device 108, the technician may also input control instructions through the display device 108 and send them to the controller 107, and the controller 107 may output instructions to control other devices according to the control instructions. In the foregoing embodiment, the proportional relationship between the flow of chemical agent and the discharge amount value of the fracturing fluid stored in the memory of the controller 107 may be input by the technician through the display device 108 in advance.

In some embodiments, through the above solution, the controller 107 controls the first delivery pump according to the discharge amount value of the fracturing fluid pumped by the fracturing pump. This process may be to control the first delivery pump according to the discharge amount value of the fracturing fluid detected by the first flow detector 104 and the proportional relationship stored by the memory. It is also possible to transmit the discharge amount value of the fracturing fluid to the display device 108 for displaying, and the technician may input control instructions through the display device 108 according to the displayed discharge amount value of the fracturing fluid, such as increasing the amount of addition of chemical agents or reducing the amount of addition of chemical agents, etc. Then the controller 107 controls the first delivery pump 102 according to the control instruction, thereby realizing the flexible control of the first delivery pump 102.

Figure 3:
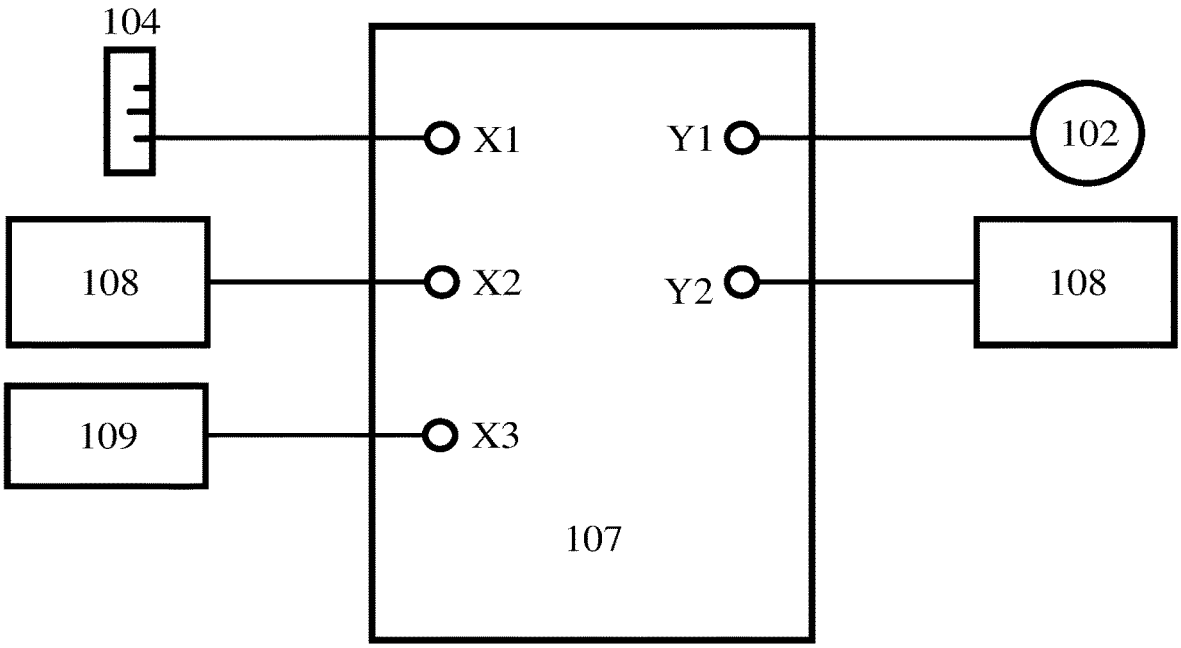
FIG. 3 is a schematic structural diagram of still another fracturing control apparatus according to some embodiments of the present application.

Further, in one embodiment, the fracturing control apparatus 10 provided by the embodiment of the present application further includes a control mode information collection device 109, as shown in FIG. 3, the control mode information collection device 109 is connected with the third input interface X3 of the controller 107.

The control mode may include a manual control mode, an automatic control mode, and the like.

The control mode information collection device 109 may collect the control mode input by the technician, and the control mode information collection device 109 may be a button, a selector (such as an either-or selector), and the like. For example, when the control mode information collection device 109 is an either-or selector, the technician may select one control mode from the manual control mode and the automatic control mode through the either-or selector.

When the control mode collected by the control mode information collection device 109 is a manual control mode, the technician may input control instructions through the display device 108 according to the discharge amount value of the fracturing fluid displayed on the display device 108, such as setting the amount of addition of chemical agents, the flow of chemical agent pumped by the first delivery pump 102, etc., and then the controller 107 controls the flow of the chemical agent pumped by the first delivery pump 102 according to the control instructions. In practical applications, the technician may directly rotate the flow adjustment knob to control the first delivery pump 102 according to the discharge amount value of the fracturing fluid displayed on the display device 108, the flow of the chemical agent pumped by the first delivery pump 102 may be changed by rotating the flow adjustment knob, and the flow adjustment knob may be remotely connected with the first delivery pump 102. When the control mode collected by the control mode information collection device 109 is the automatic control mode, the controller 107 may determine the target flow of the chemical agent corresponding to the current discharge amount value of the fracturing fluid according to the discharge amount value of the fracturing fluid detected by the first flow detector 104 and the proportional relationship stored in the memory, and then adjust the flow of the chemical agent pumped by the first delivery pump 102 according to the target flow of the chemical agent.

In some embodiments, in the above solution, after the control mode collected by the control mode information collection device 109 is acquired, the corresponding control process is performed, thereby avoiding erroneous control of the first delivery pump 102. For example, in the automatic control mode, the technician mistakenly touches the display device 108 to input a control instruction, while in the above solution, the controller 107 will respond to the control instruction input by the technician through the display device 108 only when the technician selects the manual control mode. Thus, in the automatic control mode, if the technician mistakenly touches the display device 108 to input a control instruction, the erroneous control of the first delivery pump 102 will not be caused.

Figure 4:
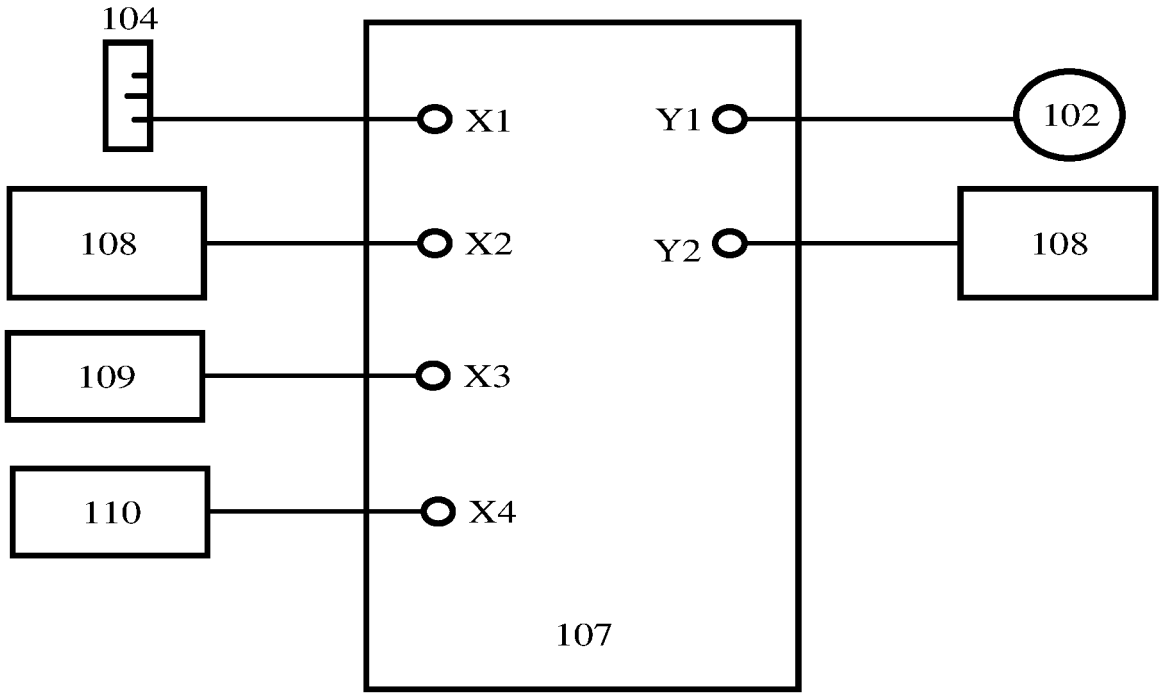
FIG. 4 is a schematic structural diagram of still another fracturing control apparatus according to some embodiments of the present application.

Further, the fracturing control apparatus 10 provided in the embodiment of the present application further includes a fault information acquisition device 110. As shown in FIG. 4, the fault information acquisition device 110 is connected with a fourth input interface X4 of the controller 107.

The fault information acquisition device 110 may collect fault information of various pipelines and various devices, and may collect pressure, temperature, speed, and component fault information. For example, the fault information acquisition device 110 may be a pressure detector, and the number of the pressure detectors may be multiple, which may be arranged in the pipeline, or may be arranged on the first delivery pump 102 and the fracturing pump 103. When the pressure detector detects overpressure in the pipeline, the first delivery pump 102, or the fracturing pump 103, the overpressure information may be sent to the controller 107. The fault information acquisition device 110 is illustrated as the pressure detector for example (the fault information acquisition device may also be a temperature detector, etc.), and the embodiment of the present application does not limit the type and installation position of the fault information acquisition device 110.

In some embodiments, in the above solution, the fault information acquisition device 110 is arranged, and the fault information acquisition device 110 is connected with the fourth input interface X4 of the controller 107, so that the controller 107 may obtain the fault information, and adjust the flow of the chemical agent pumped by the first delivery pump 102 after the fault is solved. Further, the fault information may be displayed on the display device 108 to prompt the technician for the specific fault location, fault reason, and the like.

Figure 5:
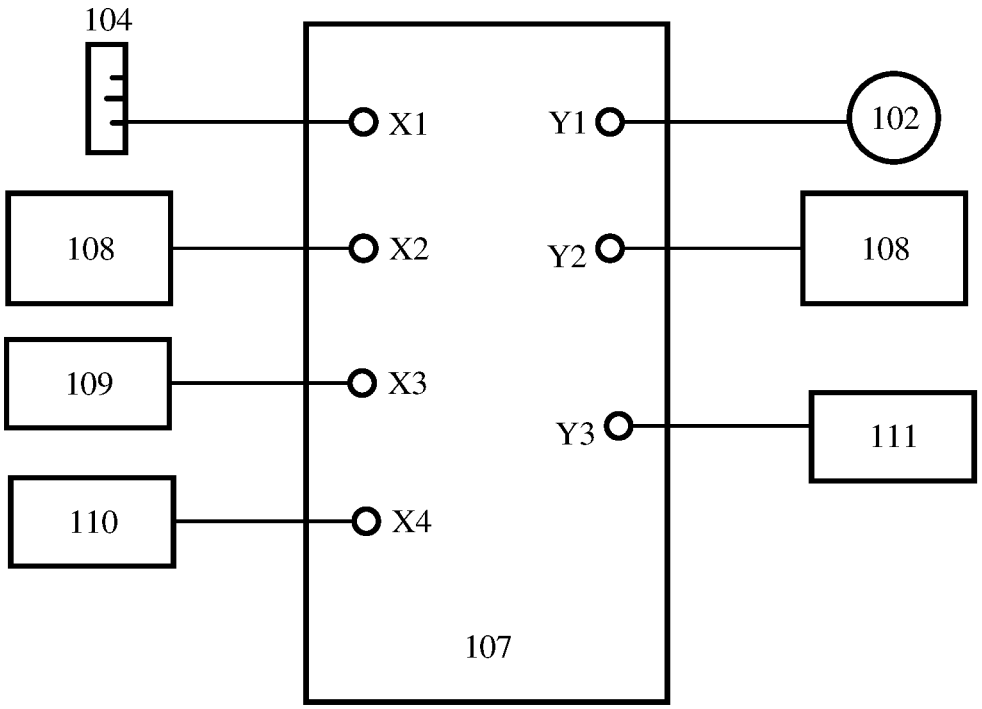
FIG. 5 is a schematic structural diagram of still another fracturing control apparatus according to some embodiments of the present application.

Further, the fracturing control apparatus 10 provided in the embodiment of the present application further includes an alarm 111. As shown in FIG. 5, the alarm 111 is connected with a third output interface Y3 of the controller 107.

The alarm 111 may be used for transmitting information to alert technicians when the fault information acquisition device 110 collects the fault information. The alarm 111 may include warning lights and/or buzzers.

In some embodiments, in the above solution, the alarm 111 is arranged, and the alarm 111 is connected with the third output interface Y3 of the controller 107, so that the controller 107 may further control the alarm 111 to give an alarm after acquiring the fault information collected by the fault information acquisition device 110, so as to remind the technician to eliminate the fault as soon as possible.

Figures 1, 6:
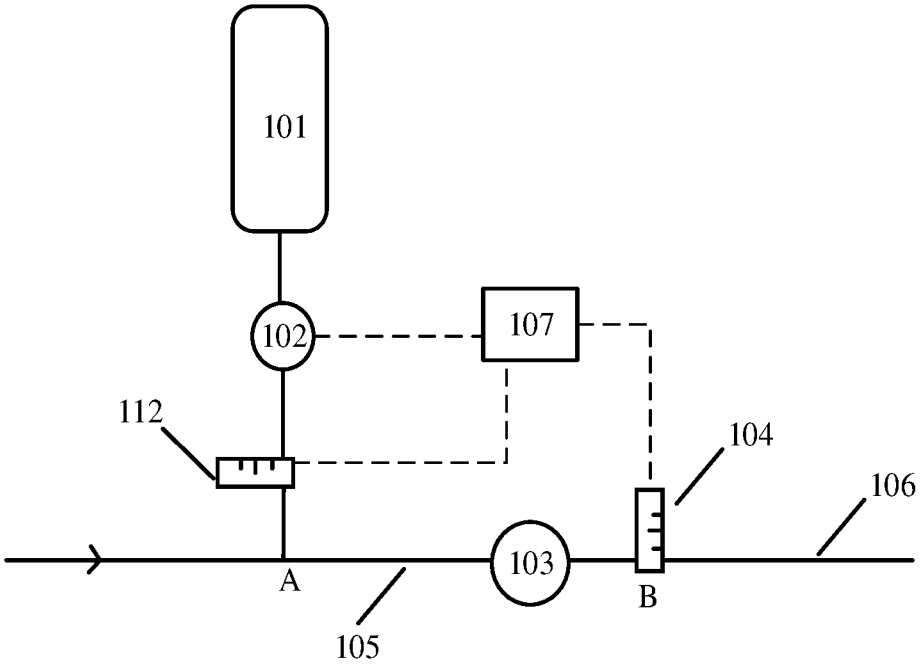
Figures 2, 6:
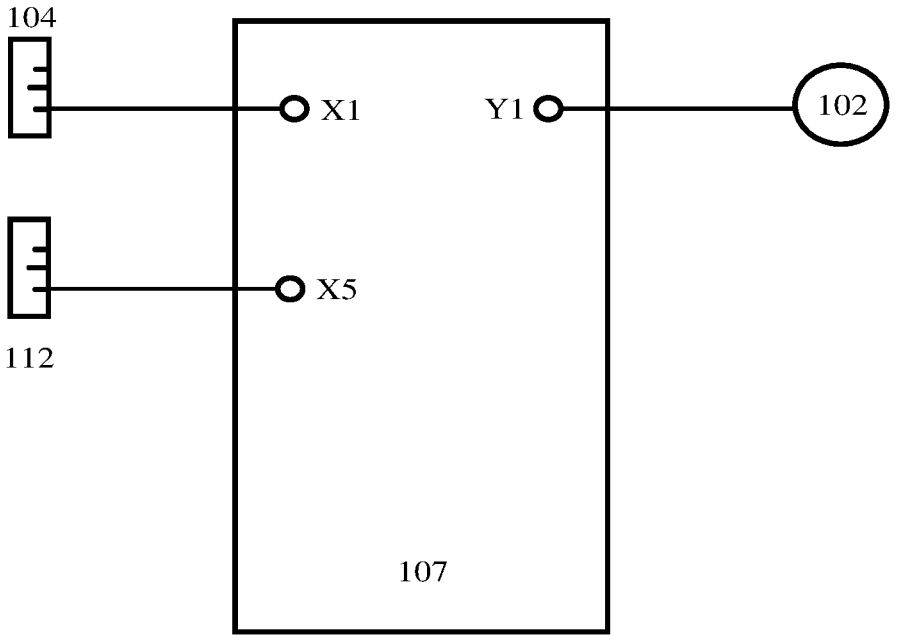

In order to further accurately adjust the added amount of chemical agents according to the discharge amount value of the fracturing fluid pumped by the fracturing pump 103 and detected by the first flow detector 104, in one embodiment, the fracturing control apparatus 10 provided in the embodiment of the present application further includes a second flow detector 112. As shown in FIG. 6-1 and FIG. 6-2, the material outlet of the first delivery pump 102 communicates with the first position A of the first fracturing fluid conveying pipeline 105 via the second flow detector 112, and the second flow detector 112 is connected with a fifth input interface X5 of the controller 107.

The second flow detector 112 may be used to detect the flow of the chemical agent delivered by the first delivery pump 102 to the first fracturing fluid conveying pipeline 105. Further, the controller 107 adjusts the addition of chemical agent according to the discharge amount value of the fracturing fluid pumped by the fracturing pump 103 and detected by the first flow detector 104, the flow of the chemical agent delivered by the first delivery pump 102 into the first fracturing fluid conveying pipeline 105 detected by the second flow detector 112, and the automatic control mode. The process of adjusting the addition of chemical agent may be as follows.

At a first step, the controller determines whether the flow of the chemical agent delivered by the first delivery pump 102 matches the discharge amount value of the fracturing fluid according to the discharge amount value of the fracturing fluid pumped by the fracturing pump 103 and detected by the first flow detector 104, the flow of the chemical agent delivered by the first delivery pump 102 into the first fracturing fluid conveying pipeline 105 detected by the second flow detector 112, and the proportional relationship between the chemical agent flow and the discharge amount value of the fracturing fluid pre-stored in the controller 107; if not, the second step is performed; if matches, the third step is performed.

At a second step, the controller controls the first delivery pump 102 to adjust the flow of the chemical agent pumped by the first delivery pump 102.

At a third step, the process ends.

Further, the controller 107 adjusts the addition of chemical agent according to the discharge amount value of the fracturing fluid pumped by the fracturing pump 103 and detected by the first flow detector 104, the flow of the chemical agent delivered by the first delivery pump 102 into the first fracturing fluid conveying pipeline 105 and detected by the second flow detector 112, and the manual control mode. The process for adjusting the addition of chemical agent may be as follows.

At a first step, the controller receives a setting flow for addition of the chemical agent input by the technician according to the discharge amount value of the fracturing fluid pumped by the fracturing pump 103.

The technician may input the setting flow for addition of the chemical agent through the display device 108.

At a second step, the controller controls the first delivery pump 102 to adjust the flow of the chemical agent pumped by the first delivery pump 102.

At a third step, the controller determines whether the flow of the chemical agent delivered by the first delivery pump 102 matches the input setting flow for addition of the chemical agent, if not, the second step is performed; if matches, a fourth step is performed.

At the fourth step, the process ends.

In some embodiments, in the above solution, the controller 107 is connected with the second flow detector 112 for detecting the flow of the chemical agent delivered by the first delivery pump 102 into the first fracturing fluid conveying pipeline 105, so that the controller 107 may accurately control the first delivery pump 102 according to the discharge amount value of the fracturing fluid pumped by the fracturing pump 103 and the flow of the chemical agent delivered by the first delivery pump 102 into the first fracturing fluid conveying pipeline 105, so that the amount of addition of chemical agents reaches the expected level to meet the demands of fracturing operations.

Figures 1, 7:
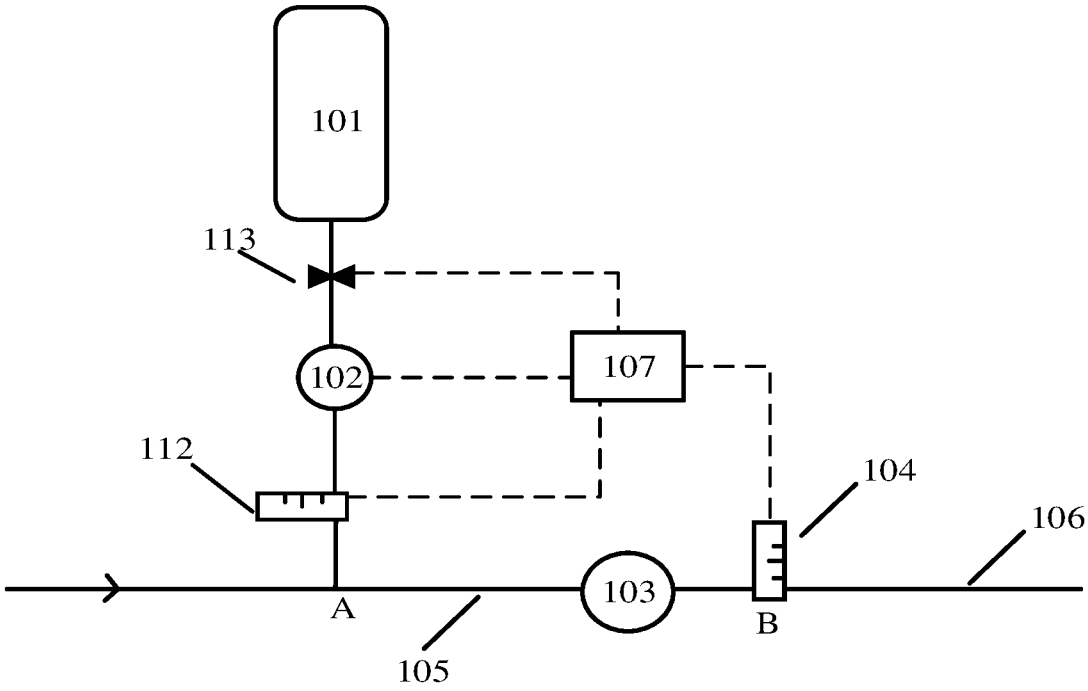
Figures 2, 7:
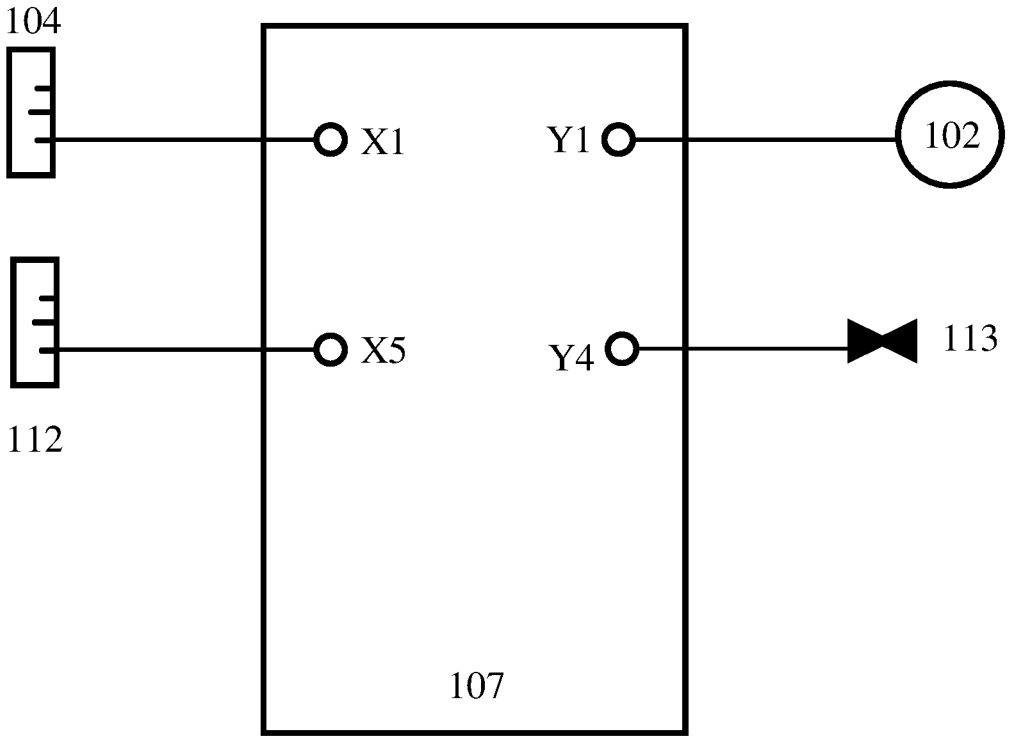

In order to match the flow of chemical agent with the discharge amount value of the fracturing fluid, in one embodiment, the fracturing control apparatus 10 provided by the embodiment of the present application further includes a first valve 113. As shown in FIG. 7-1 and FIG. 7-2, the first chemical agent storage tank 101 is connected with the first delivery pump 102 via the first valve 113, and the first valve 113 is connected with a fourth output interface Y4 of the controller 107.

The first valve 113 is a valve with adjustable opening degree, and may be a proportional valve in particular. The larger the opening degree of the first valve 113 is, the more chemical agent is delivered from the first chemical agent storage tank 101 to the first delivery pump 102; conversely, the smaller the opening degree of the first valve 113 is, the less chemical agent is delivered from the first chemical agent storage tank 101 to the first delivery pump 102.

In some embodiments, in the above solution, the first valve 113 is connected with the fourth output interface Y4 of the controller 107, so that the controller 107 may control the opening degree of the first valve 113 according to the target flow of the chemical agent corresponding to the discharge amount value of the fracturing fluid or the setting flow for addition of the chemical agent input by the technician, thus the flow of chemical agent may be matched with the discharge amount value of the fracturing fluid.

Figures 1, 8:
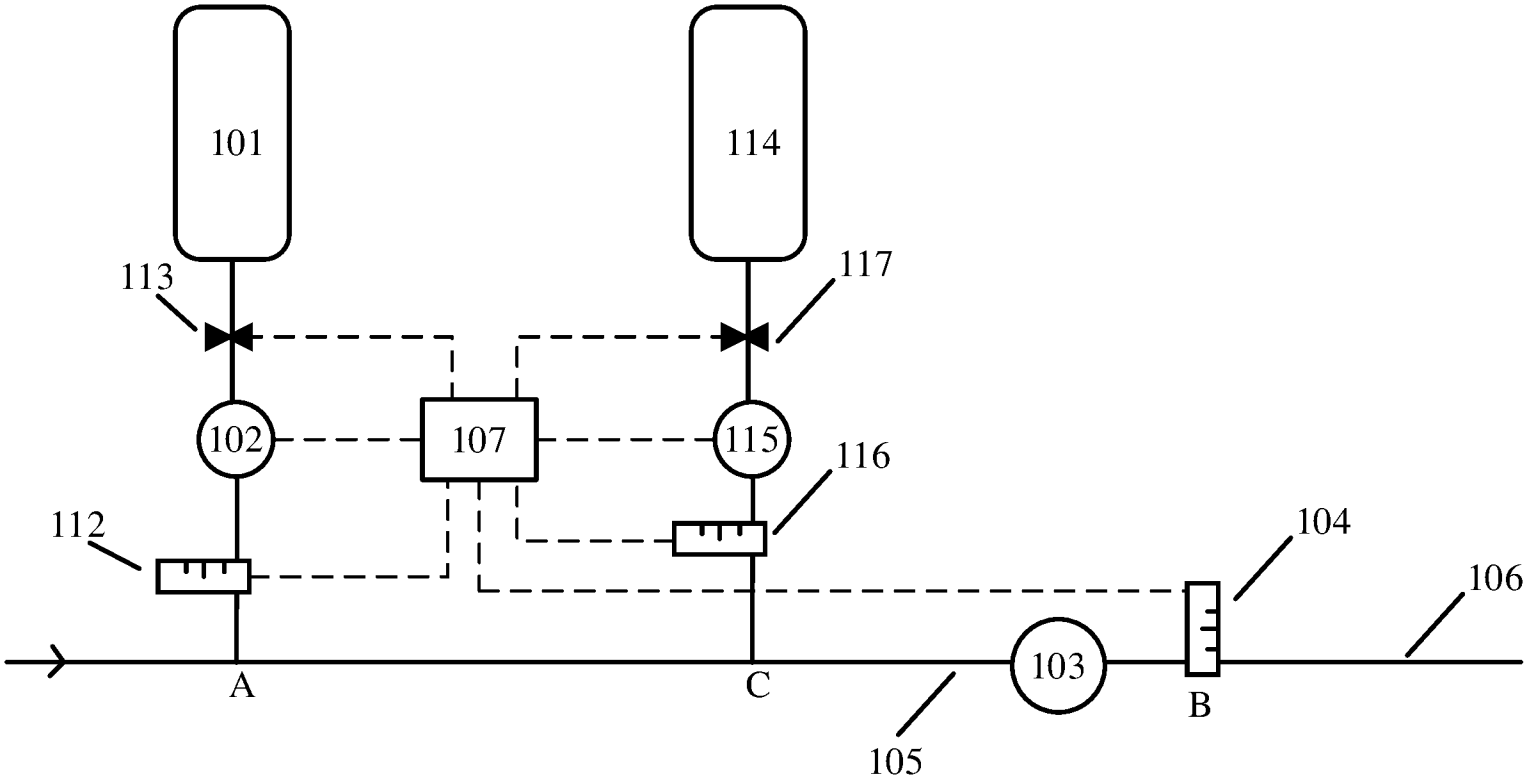
Figures 2, 8:
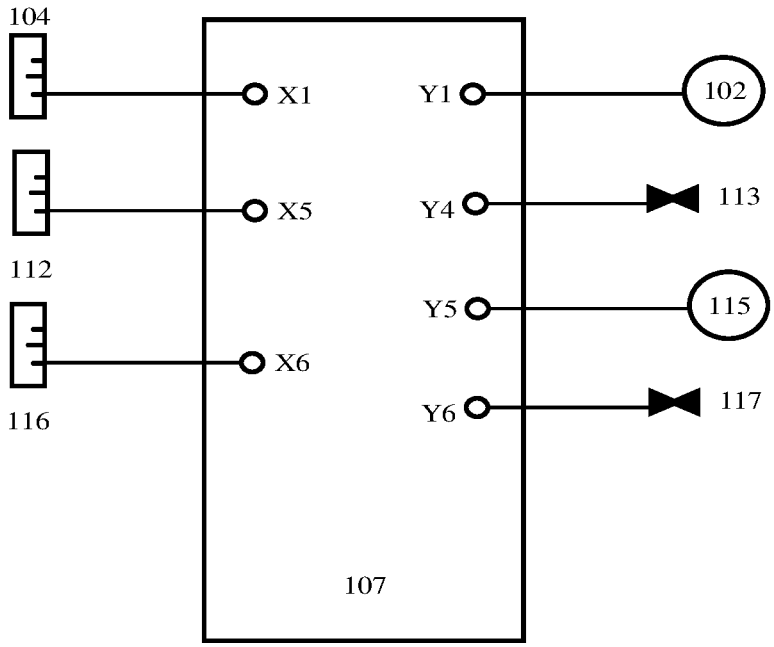

In some embodiments, more than one chemical agent may need to be added to the fracturing fluid. In order to realize timely control of the amount for addition of various chemical agents. In one embodiment, the fracturing control apparatus 10 provided in the embodiment of the present application further includes a second chemical agent storage tank 114 and a second delivery pump 115. As shown in FIG. 8-1 and FIG. 8-2, the second chemical agent storage tank 114 is connected with the second delivery pump 115, and a material outlet of the second delivery pump 115 is connected with a third position C of the first fracturing fluid conveying pipeline 105; the second delivery pump 115 is connected with a fifth output interface Y5 of the controller 107.

The second chemical agent storage tank 114 may store chemical agents different from that in the first chemical agent storage tank 101. The second chemical agent storage tank 114 is connected with the second delivery pump 115, and may be used to provide chemical material for the second delivery pump 115.

The material outlet of the second delivery pump 115 is communicated with the third position C of the first fracturing fluid conveying pipeline 105, which may provide the power to transmit the chemical agent in the second chemical agent storage tank 114 to the first fracturing fluid conveying pipeline 105, so that the chemical agent is mixed in the first fracturing fluid conveying pipeline 105 with the fracturing fluid delivered in the first fracturing fluid conveying pipeline 105. The third position C may be upstream of the first position A or downstream of the first position A. The directional words "upstream" and "downstream" used in the embodiments of the present application refer to the flow direction of the liquid in the pipeline.

The second delivery pump 115 is connected to the fifth output interface Y5 of the controller 107. In one example, the power element of the second delivery pump 115 may be connected with the fifth output interface Y5 of the controller 107. The controller 107 may output an instruction to adjust the operating state of the power element, so as to control the flow of the chemical agent pumped by the second delivery pump 115. In some embodiments, the second delivery pump 115 may be a plunger pump, a rotor pump, a centrifugal pump, etc., and the power element may be an engine, a motor, a hydraulic power take-off, and the like.

In some embodiments, the controller 107 may collect the discharge amount value of the fracturing fluid pumped by the fracturing pump 103 and detected by the first flow detector 104, and adjust the flow of the chemical agent pumped by the first delivery pump 102 and the flow of the chemical agent pumped by the second delivery pump 115 according to the discharge amount value of the fracturing fluid pumped by the fracturing pump 103, thereby realizing timely control of the amount of addition of various chemical agent in the fracturing fluids. In some embodiments, the first chemical agent storage tank 101, the second chemical agent storage tank 114, the first delivery pump 102, and the second delivery pump 115 are included in the embodiment of the present application only as an example, which is not a limitation to the embodiments of the present application. In some embodiments, more chemical agent storage tanks and delivery pumps may also be included to realize timely control of the amount of addition of more chemical agents. In the case of multiple chemical agent storage tanks and delivery pumps, the controller 107 may also turn on different delivery pumps according to the operation conditions. For example, in the early stage of the fracturing operation, it is only necessary to add the chemical agent from the first chemical agent storage tank 101 to the fracturing fluid, then the first delivery pump 102 may be controlled to work, and the second delivery pump 115 may be controlled to stop. In the later stage of the fracturing operation, it is only necessary to add the chemical agent from the second chemical agent storage tank 114 to the fracturing fluid, and the first delivery pump 102 may be controlled to stop, and the second delivery pump 115 may be controlled to work.

In order to further accurately adjust the addition amount of the chemical agents in the second chemical agent storage tank 114 according to the discharge amount value of the fracturing fluid pumped by the fracturing pump 103 and detected by the first flow detector 104, in one embodiment, the fracturing control apparatus 10 provided in the embodiment of the present application further includes a third flow detector 116 and a second valve 117. As shown in FIG. 8-1 and FIG. 8-2, the material outlet of the second delivery pump 115 communicates with the third position C of the first fracturing fluid conveying pipeline 105 via the third flow detector 116, and the third flow detector 116 is connected with a sixth input interface X6 of the controller 107. The second chemical agent storage tank 114 is connected with the second delivery pump 115 via the second valve 117, and the second valve 117 is connected with a sixth output interface Y6 of the controller 107.

The third flow detector 116 may be used to detect the flow of the chemical agent delivered by the second delivery pump 115 to the first fracturing fluid conveying pipeline 105. The controller 107 adjusts the addition of chemical agents according to the discharge amount value of the fracturing fluid pumped by the fracturing pump 103 and detected by the first flow detector 104, the flow of the chemical agent delivered by the second delivery pump 115 into the first fracturing fluid conveying pipeline 105 detected by the third flow detector 116, and the automatic control mode and manual control mode respectively, the process of adjusting the addition of chemical agents based on the automatic control mode and manual control mode may be referenced to the above-mentioned control process of the controller 107 on the first delivery pump 102, which will not be repeated here.

The second valve 117 is a valve with adjustable opening degree, and may be a proportional valve in particular. The larger the opening degree of the second valve 117 is, the more chemical agent is delivered from the second chemical agent storage tank 114 to the second delivery pump 115; conversely, the smaller the opening degree of the second valve 117 is, the less chemical agent is delivered from the second chemical agent storage tank 114 to the second delivery pump 115.

In some embodiments, the controller 107 is connected with a third flow detector 116 for detecting the flow of chemical agent delivered by the second delivery pump 115 to the first fracturing fluid conveying pipeline 105, and the controller 107 is connected with the second valve 117, so that the controller 107 may control the second delivery pump 115 and the second valve 117 according to the target flow of the chemical agent corresponding to the discharge amount value of the fracturing fluid or according to the setting flow for addition of the chemical agent input by the technician, so as to make the amount of addition of chemical agents reaches the expected level to meet the demands of fracturing operations.

Considering that a continuous transmission of the chemical agent to the first fracturing fluid conveying pipeline 105 by the first delivery pump 102 may be affected when the remaining chemical agent in the first chemical agent storage tank 101 is too small, therefore, in one embodiment, the control device 10 provided in this embodiment of the present application further includes a first liquid level detector, the first liquid level detector is arranged on the first chemical agent storage tank 101, and the first liquid level detector is connected with the controller 107.

The first liquid level detector may be used to detect the liquid level of the chemical agent in the first chemical agent storage tank 101, and the first liquid level detector may be a differential pressure level meter. The first liquid level detector is connected with the controller 107. In one example, it may be connected with the input interface of the controller 107, and is used to send the collected chemical agent level information in the first chemical agent storage tank 101 to controller 107.

In some embodiments, the controller 107 is connected with the first liquid level detector, the controller 107 may obtain the chemical agent liquid level information of the first chemical agent storage tank 101 and further display it on the display device 108, thereby realizing the real-time monitoring of the remaining chemical agent in the first chemical agent storage tank 101. In the case that the remaining chemical agent in the first chemical agent storage tank 101 is too small, the technician may replenish the chemical agent to the first chemical agent storage tank 101 in time.

Figure 9:
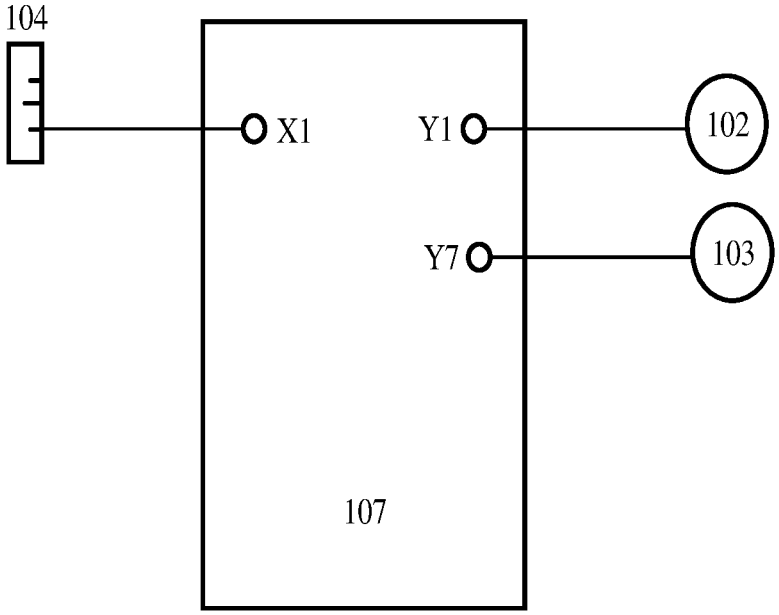
FIG. 9 is a schematic structural diagram of still another fracturing control apparatus according to some embodiments of the present application.

In order to adjust the discharge amount value of the fracturing fluid pumped by the fracturing pump 103 in time, so that it may quickly reach the target discharge to meet the demands of the fracturing operation, in one embodiment, the fracturing pump 103 is connected with the seventh output interface Y7 of the controller 107, as shown in FIG. 9.

In some embodiments, the controller 107 may timely adjust the flow of the fracturing fluid pumped by the fracturing pump 103 according to the target discharge, which may be input by the technician through the display device 108.

Figures 1, 10:
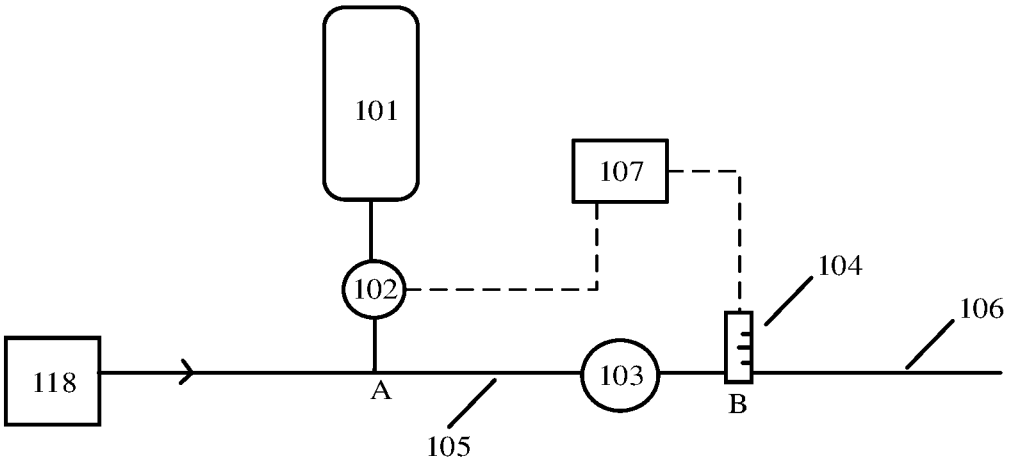
Figures 2, 10:
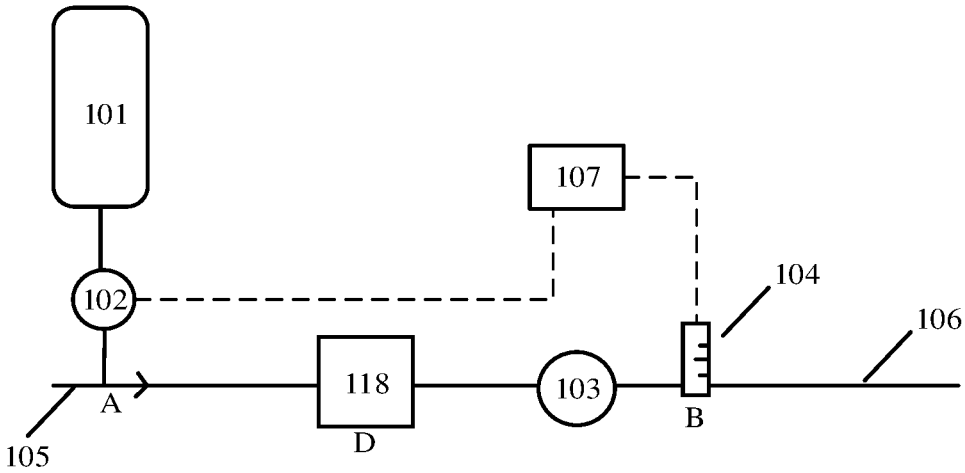

In some embodiments, the fracturing control apparatus 10 provided in the embodiment of the present application further includes a liquid supply device 118, and the material outlet of the liquid supply device 118 is communicated with the inlet of the first fracturing fluid conveying pipeline 105, as shown in FIG. 10-1; or, the liquid supply device 118 is arranged at a fourth position D of the first fracturing fluid conveying pipeline 105, and the fourth position is located downstream of the first position, as shown in FIG. 10-2.

The liquid supply device 118 may be a centrifugal pump. The position of the liquid supply device 118 may be set according to the type of the added chemical agent. For example, when the added chemical agent is a chemical agent that is foamy (easy to foam), the material outlet of the liquid supply device 118 may be communicated with the inlet of the first fracturing fluid conveying pipeline 105, that is, the liquid supply device 118 is arranged at the inlet of the first fracturing fluid conveying pipeline 105; when the added chemical agent is a chemical agent that is not foamy (not easy to foam), the liquid supply device 118 may be set at the fourth position D of the first fracturing fluid conveying pipeline 105.

In some embodiments, through the above solution, the liquid supply device 118 is added, so that more power may be provided to smoothly transmit the fracturing fluid to the wellbore for fracturing operation.

Figure 11:
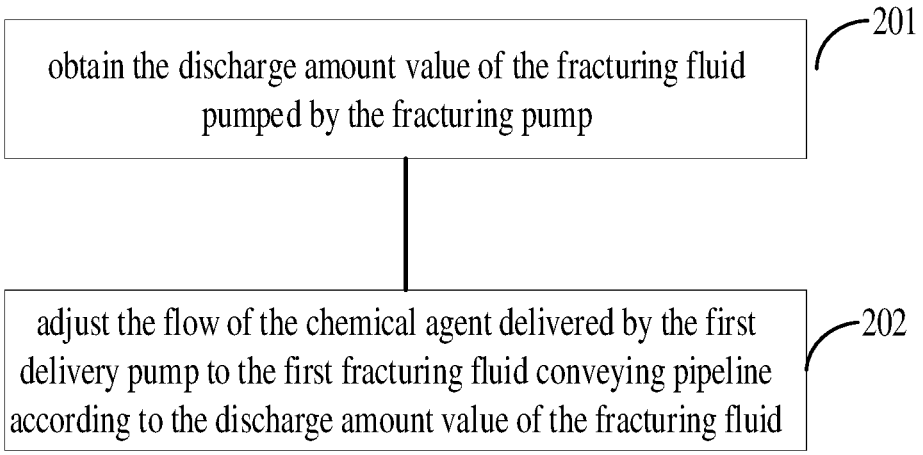
FIG. 11 is a schematic flowchart of a control method according to some embodiments of the present application.

Based on the fracturing control apparatus 10 provided by the embodiments of the present application, the embodiments of the present application further provide a control method applied to the fracturing control apparatus 10, and the execution body of the control method may be a controller, as shown in FIG. 11, the method includes the following steps.

At step 201, the discharge amount value of the fracturing fluid pumped by the fracturing pump is acquired.

The discharge amount value of the fracturing fluid pumped by the fracturing pump may be detected by the first flow detector.

At step 202, the flow of the chemical agent delivered by the first delivery pump into the first fracturing fluid conveying pipeline is adjusted according to the discharge amount value of the fracturing fluid.

The flow of the chemical agent delivered by the first delivery pump to the first fracturing fluid conveying pipeline may be detected by the second flow detector. Adjusting the flow of the chemical agent delivered by the first delivery pump to the first fracturing fluid conveying pipeline may be to control the first delivery pump by adjusting the operating state of the power element of the first delivery pump, and then control the flow of the pumped chemical agent. For example, when the first delivery pump is a rotor pump, the flow of the pumped chemical agent may be controlled by controlling the rotational speed.

In some embodiments, the controller may obtain the discharge amount value of the fracturing fluid pumped by the fracturing pump, and adjust the flow of the chemical agent pumped by the first delivery pump according to the discharge amount value of the fracturing fluid pumped by the fracturing pump. The adjustment of the amount of addition of chemical agent in the fracturing fluid is realized, thereby obviating manual control performed by technicians at operation site, and realizing timely control of the amount of addition of chemical agents.

In one embodiment, before the adjusting the flow of the chemical agent delivered by the first delivery pump into the first fracturing fluid conveying pipeline according to the discharge amount value of the fracturing fluids, the method further includes: acquiring a control mode, the control mode including an automatic control mode; the adjusting the flow of the chemical agent delivered by the first delivery pump into the first fracturing fluid conveying pipeline according to the discharge amount value of the fracturing fluids, includes: adjusting according to the discharge amount value of the fracturing fluids and a pre-stored target flow of the chemical agent corresponding to the discharge amount value of the fracturing fluids, the flow of the chemical agent delivered by the first delivery pump into the first fracturing fluid conveying pipeline to the target flow of the chemical agent when the control mode is the automatic control mode.

The proportional relationship between the flow of the chemical agent and the discharge amount value of the fracturing fluid may be pre-stored in the controller, and a target flow of chemical agent corresponding to the discharge amount value of the fracturing fluid may be determined according to the obtained discharge amount value of the fracturing fluid pumped by the fracturing pump. The pre-stored proportional relationship between the flow of the chemical agent and the discharge amount value of the fracturing fluid may be input by the technician through a display device.

In one embodiment, before the adjusting the flow of the chemical agent delivered by the first delivery pump into the first fracturing fluid conveying pipeline according to the discharge amount value of the fracturing fluids, the method further includes: acquiring a control mode, the control mode including a manual control mode; the adjusting the flow of the chemical agent delivered by the first delivery pump into the first fracturing fluid conveying pipeline according to the discharge amount value of the fracturing fluids, includes: acquiring a setting flow of the chemical agent inputted by the user, and adjusting the flow of the chemical agent delivered by the first delivery pump into the first fracturing fluid conveying pipeline to the setting flow of the chemical agent when the control mode is the manual control mode.

The user may be a technician, and the user may input the setting flow of the chemical agent through a display device or a flow adjustment knob.

In some embodiments, adjusting by the controller the flow of the chemical agent delivered by the first delivery pump into the first fracturing fluid conveying pipeline according to the discharge amount value of the fracturing fluids may include: adjusting the flow of the chemical agent according to the discharge amount value of the fracturing fluid and the pre-stored proportional relationship, or, delivering the discharge amount value of the fracturing fluid to the display device for display, and inputting by the technician control instructions through the display device or the flow adjustment knob according to the displayed discharge amount value of the fracturing fluid, such as increasing the amount of addition of chemical agents or reducing the amount of addition of chemical agents, etc., and then adjusting by the controller the flow of chemical agent according to the control instructions. Thus, the flexible control of the flow of chemical agent is achieved.

Figure 12:
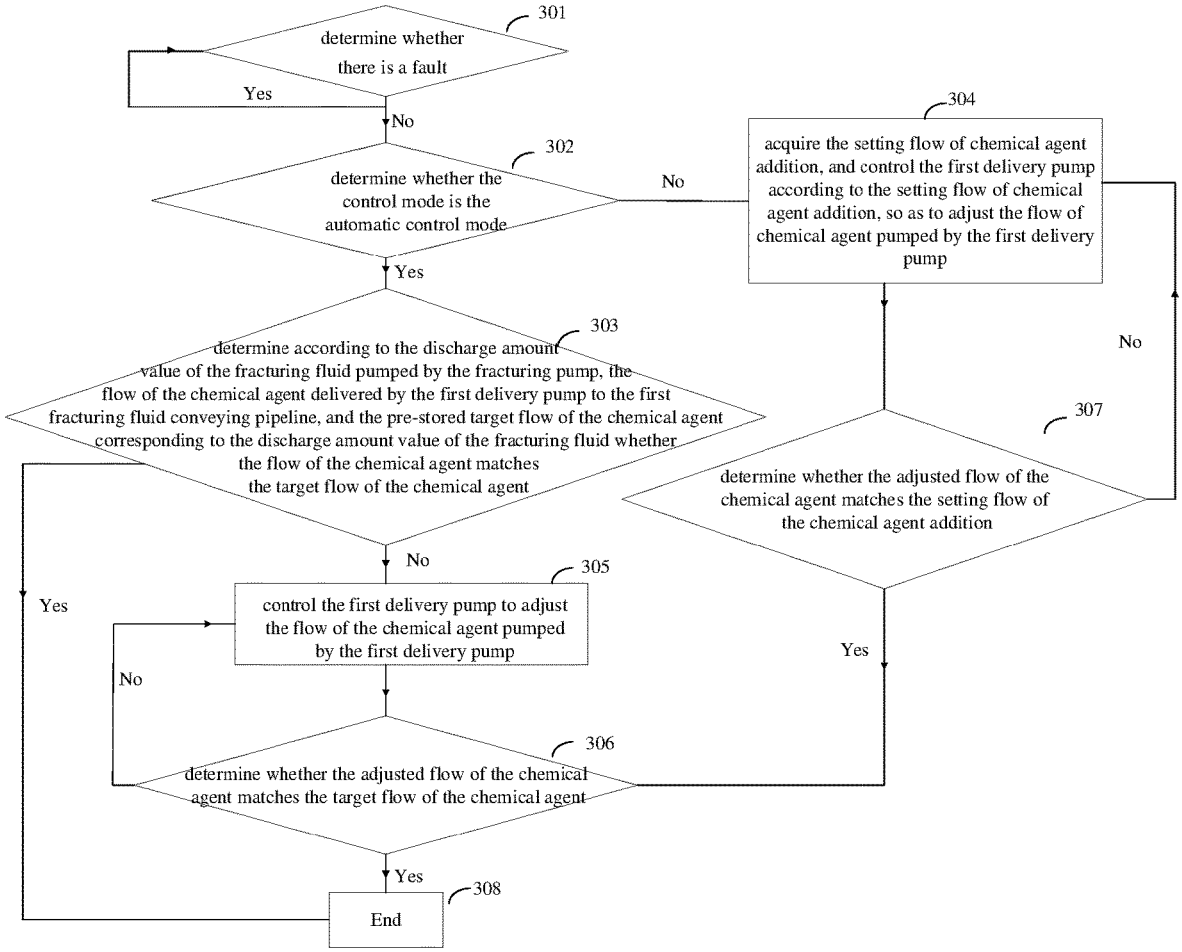
FIG. 12 is a schematic flowchart of another control method according to some embodiments of the present application.

In some embodiments, it is also possible to adjust the flow of the chemical agent delivered by the first delivery pump after troubleshooting. Based on this, the embodiment of the present application also provides another control method applied to the fracturing control apparatus 10, as shown in FIG. 12, the method includes the following steps.

At step 301, whether there is a fault is determined, if there is no fault, step 302 is performed; if there is a fault, step 301 is performed.

Determining whether there is a fault may be performed by determining whether the fault information acquisition device collects the fault information, and the fault may be the fault in the pipeline or the fault in the device. When there is a fault, the fault information may be displayed on the display device to prompt the technician to repair as soon as possible, and step 301 is repeatedly performed until the fault is resolved, and then step 302 is performed.

At step 302, it is determined whether the control mode is the automatic control mode, if yes, step 303 is performed; if not, step 304 is performed.

Determining whether the control mode is the automatic control mode may be performed according to the control mode collected by the control mode information collection device, for details, reference may be made to the foregoing embodiments, which will not be repeated here.

At step 303, whether the flow of the chemical agent matches the target flow of the chemical agent is determined according to the discharge amount value of the fracturing fluid pumped by the fracturing pump, the flow of the chemical agent delivered by the first delivery pump into the first fracturing fluid conveying pipeline, and the pre-stored target flow of the chemical agent corresponding to the discharge amount value of the fracturing fluid; if it does not match, go to Step 305, if it matches, go to Step 308.

At step 304, the setting flow of addition of the chemical agent is acquired, and the first delivery pump is controlled according to the setting flow of addition of the chemical agent, so as to adjust the flow of chemical agent pumped by the first delivery pump, and step 307 is performed.

The setting flow of addition of the chemical agent may be input by the technician according to the discharge amount value of the fracturing fluid pumped by the fracturing pump. In one example, it may be input through a display device or through a flow adjustment knob.

At step 305, the first delivery pump is controlled to adjust the flow of the chemical agent pumped by the first delivery pump.

The control of the first delivery pump may be to control the rotational speed of the first delivery pump. The rotational speed of the first delivery pump is increased to increase the flow of the chemical agent, and the rotational speed of the first delivery pump is decreased, to decrease the flow of the chemical agent.

At step 306, whether the adjusted flow of the chemical agent matches the target flow of the chemical agent is determined, if matches, step 308 is performed, if not matches, step 305 is performed.

In some embodiments, the first flow detector may detect the discharge amount value of the fracturing fluid pumped by the fracturing pump in real time, and the second flow detector may detect the flow of the chemical agent delivered by the first delivery pump into the first fracturing fluid conveying pipeline in real time. Thus, the controller may obtain real-time data, and further verify whether the flow of the chemical agent delivered by the first delivery pump matches the target flow of the chemical agent according to the discharge amount value of the fracturing fluid pumped by the fracturing pump and detected by the first flow detector, the flow of the chemical agent delivered by the first delivery pump into the first fracturing fluid conveying pipeline and detected by the second flow detector, and the target flow of chemical agent corresponding to the discharge amount value of the fracturing fluid pre-stored in the controller, after control of the first delivery pump.

At step 307, whether the adjusted flow of the chemical agent matches the setting flow of the chemical agent addition is determined, if matches, step 308 is performed, if not matches, step 304 is performed.

In some embodiments, the second flow detector may detect the flow of the chemical agent delivered by the first delivery pump to the first fracturing fluid conveying pipeline in real time. Then the controller may acquire real-time data, and may further verify according to the flow of the chemical agent delivered by the first delivery pump to the first fracturing fluid conveying pipeline and detected by the second flow detector, whether it matches the setting flow of the chemical agent addition after control of the first delivery pump.

At step 308, the process ends.

In some embodiments, through the above solution, the controller may collect the discharge amount value of the fracturing fluid pumped by the fracturing pump and detected by the first flow detector, control the first delivery pump according to the discharge amount value of the fracturing fluid pumped by the fracturing pump, and then adjust the flow of the chemical agent pumped by the first delivery pump, so as to realize the adjustment of the amount of addition of the chemical agent in the fracturing fluid, so as to obviating manual control performed by technicians at operation site, and realizing timely control of the amount of addition of the chemical agents.

Figure 13:
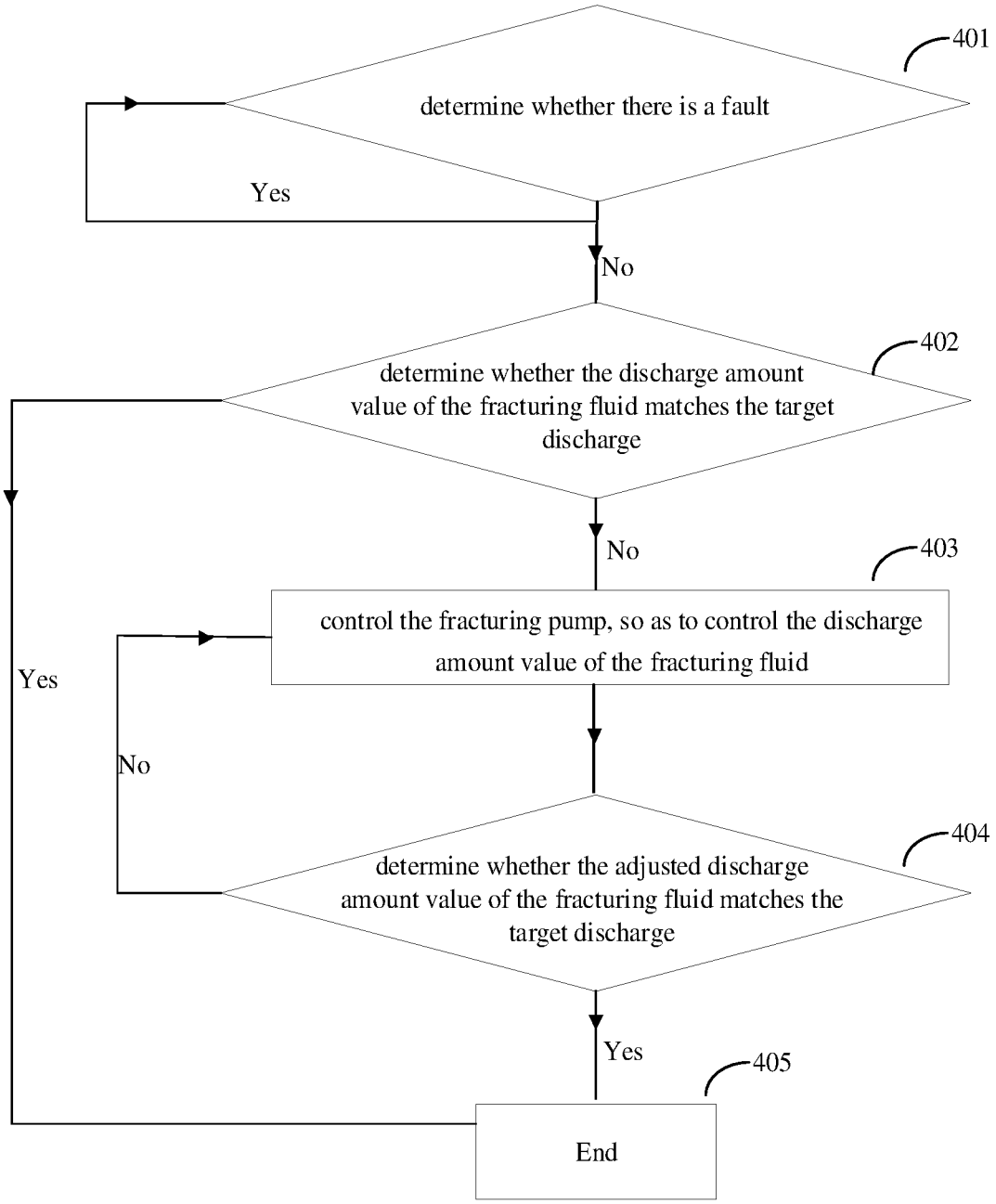
FIG. 13 is a schematic flowchart of still another control method according to some embodiments of the present application.

Based on the fracturing control apparatus 10 provided by the embodiment of the present application, the embodiment of the present application further provides another method for controlling the fracturing control apparatus 10, as shown in FIG. 13, the method includes the following steps.

At step 401, whether there is a fault is determined, if there is no fault, step 402 is performed; if there is a fault, step 401 is performed.

At step 402, whether the discharge amount value of the fracturing fluid matches the target discharge is determined, if matches, step 405 is performed, if not matches, step 403 is performed.

The target discharge may be input by a technician through a display device.

At step 403, the fracturing pump is controlled, so as to control the discharge amount value of the fracturing fluid.

At step 404, whether the adjusted discharge amount value of the fracturing fluid matches the target discharge is determined, if matches, step 405 is performed, if not matches, step 403 is performed.

In some embodiments, the first flow detector may detect the discharge amount value of the fracturing fluid pumped by the fracturing pump in real time, then the controller may obtain real-time data, and further verify whether the discharge amount value of the fracturing fluid pumped by the fracturing pump and detected by the first flow detector matches the target discharge after the control of the fracturing pump.

At step 405, the process ends.

In some embodiments, through the above solution, the controller may timely adjust the flow of the fracturing fluid pumped by the fracturing pump according to the target discharge so as to meet the demands of the fracturing operation.

The terms "including", "comprising" or any other variation thereof are intended to encompass a non-exclusive inclusion, thereby a process, a method, an article, or a device that includes a series of elements includes not only those elements, but also other elements not expressly listed, or elements inherent to the process, method, article, or device. Without further limitation, an element qualified by the phrase "including a . . . " does not preclude the presence of additional identical elements in the process, method, article, or device that includes the element.

Finally, it should be noted that the above embodiments are only used to illustrate the technical solutions of the present application, but not to limit them. Although the present application has been described in detail with reference to the foregoing embodiments, it should be understood by those skilled in the art that: it is still possible to modify the technical solutions recorded in the foregoing embodiments, or perform equivalent replacements to some of the technical features. However, these modifications or substitutions do not make the essence of the corresponding technical solutions deviate from the spirit and scope of the technical solutions of the embodiments of the present application.

What is claimed is:

1. A fracturing control apparatus, comprising a first chemical agent storage tank storing a first chemical agent, a first delivery pump, a fracturing pump, a first and a second flow detector, a first and a second fracturing fluid conveying pipeline, a centrifugal pump, and a controller, wherein:

the first chemical agent storage tank is connected with the first delivery pump;

a material outlet of the first delivery pump is connected with a first position of the first fracturing fluid conveying pipeline via the second flow detector;

the centrifugal pump is disposed at the first fracturing fluid conveying pipeline;

an outlet of the first fracturing fluid conveying pipeline is connected with an inlet of the fracturing pump;

an outlet of the fracturing pump is connected with an inlet of the second fracturing fluid conveying pipeline;

the first flow detector is arranged at a second position of the second fracturing fluid conveying pipeline;

the controller is configured to (i) receive a discharge amount value from the first flow detector and a value of a flow amount of the first chemical agent from the second flow detector, and (ii) when the discharge amount value and the value of the flow amount of the first chemical agent do not match a proportional relationship pre-stored in the controller, adjust a flow of the first chemical agent from the first chemical agent storage tank to the first fracturing fluid conveying pipeline according to the discharge amount value by sending a control instruction to the first delivery pump;

the first delivery pump is connected with a first output interface of the controller and is configured to pump the first chemical agent from the first chemical agent storage tank to the first fracturing fluid conveying pipeline based on the control instruction from the controller; and the first fracturing fluid conveying pipeline is configured to transport fracturing fluids toward the first position, receive the first chemical agent from the first delivery pump at the first position, and transport a mix of the first chemical agent and the fracturing fluids to the fracturing pump from the first position to the fracturing pump.

2. The fracturing control apparatus of claim 1, wherein:

the fracturing control apparatus further comprises a display device with an input end and a control mode information collection device;

the display device is connected with a second input interface of the controller and with a second output interface of the controller; and the control mode information collection device is connected with a third input interface of the controller.

3. The fracturing control apparatus of claim 2, wherein:

the fracturing control apparatus further comprises a fault information acquisition device and an alarm;

the fault information acquisition device is connected with a fourth input interface of the controller and configured to collect pressure, temperature, speed, or component fault information; and the alarm is connected with a third output interface of the controller.

4. The fracturing control apparatus of claim 3, wherein:

the fault information acquisition device comprises a pressure detector configured to detect overpressure in the first fracturing fluid conveying pipeline, the first delivery pump, or the fracturing pump and send the detected overpressure to the controller.

5. The fracturing control apparatus of claim 1, wherein:

the second flow detector is connected with a fifth input interface of the controller.

6. The fracturing control apparatus of claim 5, wherein:

the second flow detector is configured to detect the flow amount of the first chemical agent from the first delivery pump to the first fracturing fluid conveying pipeline and send the value of the flow amount of the first chemical agent to the controller.

7. The fracturing control apparatus of claim 5, wherein:

the fracturing control apparatus further comprises a first valve;

the first chemical agent storage tank is connected with the first delivery pump via the first valve; and the first valve is connected with a fourth output interface of the controller.

8. The fracturing control apparatus of claim 7, wherein:

the controller is configured to control an opening degree of the first valve to control a flow of the first chemical agent from the first chemical agent storage tank to the first delivery pump.

9. The fracturing control apparatus of claim 7, wherein:

the fracturing control apparatus further comprises a second chemical agent storage tank, a second delivery pump, a third flow detector, and a second valve;

the second chemical agent storage tank is connected with the second delivery pump;

a material outlet of the second delivery pump is connected with a third position of the first fracturing fluid conveying pipeline;

the second delivery pump is connected with a fifth output interface of the controller;

the material outlet of the second delivery pump is connected with the third position of the first fracturing fluid conveying pipeline by the third flow detector;

the third flow detector is connected with a sixth input interface of the controller;

the second chemical agent storage tank is connected with the second delivery pump via the second valve; and the second valve is connected with a sixth output interface of the controller.

10. The fracturing control apparatus of claim 1, wherein the fracturing pump is connected with a seventh output interface of the controller.

11. The fracturing control apparatus of claim 1, wherein the first chemical agent comprises a thickener, a cross-linking agent, a filtrate reducer, or a pH adjuster.

12. The fracturing control apparatus according to claim 1, wherein the control instruction is generated by the controller based on the proportional relationship pre-stored in the controller.

13. A control method, comprising:

detecting, by a first flow detector, a discharge amount value of fracturing fluids discharged from a fracturing pump, wherein:

a fracturing control apparatus comprises a first chemical agent storage tank, a first delivery pump, a fracturing pump, the first flow detector, a fracturing fluid conveying pipeline, a second flow detector, a second chemical agent storage tank, a second delivery pump, a third flow detector, a centrifugal pump, and a controller;

the first chemical agent storage tank is connected with the first delivery pump;

a material outlet of the first delivery pump is connected with a first position of the fracturing fluid conveying pipeline via the second flow detector;

the centrifugal pump is disposed at the fracturing fluid conveying pipeline;

an outlet of the fracturing fluid conveying pipeline is connected with an inlet of the fracturing pump;

the first delivery pump is connected with a first output interface of the controller;

the second chemical agent storage tank is connected with the second delivery pump;

a material outlet of the second delivery pump is connected with a third position of the fracturing fluid conveying pipeline downstream of the first position; and the material outlet of the second delivery pump is connected with the third position of the fracturing fluid conveying pipeline by the third flow detector;

acquiring, by the controller, a discharge amount value from the first flow detector and a value of a flow amount of a chemical agent from the second flow detector;

when the discharge amount value and the value of the flow amount of the chemical agent do not match a proportional relationship pre-stored in the controller, adjusting, by the controller, a flow of the chemical agent from the first chemical agent storage tank to the fracturing fluid conveying pipeline according to the discharge amount value by sending a control instruction to the first delivery pump;

adjusting, by the controller, a flow of a different chemical agent from the second chemical agent storage tank to the fracturing fluid conveying pipeline according to the discharge amount value by sending a different control instruction to the second delivery pump;

pumping, by the first delivery pump, the chemical agent from the first chemical agent storage tank to the fracturing fluid conveying pipeline based on the control instruction from the controller;

pumping, by the second delivery pump, the different chemical agent from the second chemical agent storage tank to the fracturing fluid conveying pipeline based on the different control instruction from the controller;

receiving, by the fracturing fluid conveying pipeline, the chemical agent from the first delivery pump at the first position and the different chemical agent from the second delivery pump at the third position; and transporting, by the centrifugal pump and the fracturing fluid conveying pipeline, the fracturing fluids to the first position, a mix of the chemical agent and the fracturing fluids to the fracturing pump from the first position to the third position, and a mix of the chemical agent, the different chemical agent, and the fracturing fluids to the fracturing pump from the third position to the fracturing pump.

14. The control method of claim 13, further comprising:

acquiring, by a control mode information collection device of the fracturing control apparatus, a control mode, the control mode comprising an automatic control mode;

wherein adjusting the flow of the chemical agent from the first chemical agent storage tank to the fracturing fluid conveying pipeline according to the discharge amount value comprises:

adjusting, according to the discharge amount value of the fracturing fluids and a pre-stored target flow of the chemical agent corresponding to the discharge amount value of the fracturing fluids, the flow of the chemical agent to the pre-stored target flow of the chemical agent when the control mode is the automatic control mode.

15. The control method of claim 13, further comprising:

acquiring, by a control mode information collection device of the fracturing control apparatus, a control mode, the control mode comprising a manual control mode;

wherein adjusting the flow of the chemical agent from the first chemical agent storage tank to the fracturing fluid conveying pipeline according to the discharge amount value comprises:

acquiring a setting flow of the chemical agent inputted by a user, and adjusting the flow of the chemical agent to the setting flow of the chemical agent when the control mode is the manual control mode.

16. The control method of claim 13, further comprising:

detecting, by a pressure detector of the fracturing control apparatus, overpressure in the fracturing fluid conveying pipeline, the first delivery pump, or the fracturing pump; and sending, by the pressure detector, the detected overpressure to the controller.

17. The control method of claim 13, further comprising:

detecting, by the second flow detector of the fracturing control apparatus, the flow amount of the chemical agent from the first delivery pump to the fracturing fluid conveying pipeline; and sending, by the second flow detector, the value of the flow amount of the chemical agent to the controller.

18. The control method of claim 13, further comprising:

controlling, by the controller, an opening degree of a first valve of the fracturing control apparatus to control a flow of the chemical agent from the first chemical agent storage tank to the first delivery pump, wherein:

the first chemical agent storage tank is connected with the first delivery pump via the first valve; and the first valve is connected with a fourth output interface of the controller.

19. The control method of claim 13, wherein the chemical agent comprises a thickener, a cross-linking agent, a filtrate reducer, or a pH adjuster.

* * * * *